United States Patent [19]

Munk

[11] 4,318,351

[45] Mar. 9, 1982

[54] STACKABLE PALLET WITH INTEGRATED STACKING MEMBERS

[75] Inventor: Edmund Munk, Oberstenfeld, Fed. Rep. of Germany

[73] Assignee: Furnier-u. Sperrholzwerk, J. F. Werz, Jr. KG, Werzalit-Pressholzwerk, Stuttgart, Fed. Rep. of Germany

[21] Appl. No.: 135,622

[22] Filed: Mar. 31, 1980

[51] Int. Cl.[3] ..... B65D 19/24

[52] U.S. Cl. ..... 108/53.1; 108/901

[58] Field of Search ..... 108/53.1, 53.3, 51.1, 108/51.3, 57.1, 901; 206/386, 596-600

[56] References Cited

U.S. PATENT DOCUMENTS

| | | | |
|---|---|---|---|
| 3,228,358 | 1/1966 | Sepe et al. | 108/53.3 |
| 3,319,799 | 5/1967 | Paxton | 108/53.3 |

FOREIGN PATENT DOCUMENTS

| | | | |
|---|---|---|---|
| 2535907 | 2/1977 | Fed. Rep. of Germany | 108/53.3 |
| 2731131 | 1/1979 | Fed. Rep. of Germany | 108/51.1 |

*Primary Examiner*—William E. Lyddane

*Attorney, Agent, or Firm*—Michael J. Striker

[57] ABSTRACT

A pallet is a unitized structure formed from a mixture of lignocellulose-containing fibers and a thermosetting bonding agent which is subjected to heat and pressure. The unit structure has conical feet and crosspieces which have integrated stacking members to permit the pallets to be stakced without damage to the stacking members and without jamming.

5 Claims, 3 Drawing Figures

STACKABLE PALLET WITH INTEGRATED STACKING MEMBERS

BACKGROUND OF THE INVENTION

The invention relates to a pallet formed from a non-expandable mixture of lignocellulose-containing fibers and a thermosetting bonding agent by subjecting the mixture to heat and pressure so as to form a one-piece structure with hollow, upwardly widened feet joined by trough-shaped crosspieces and provided with stacking members so as to produce a pallet which may be stored in a relatively small space.

Similar pallets are well known and have performed their function satisfactorily. However, they suffer from the disadvantage that when they are unloaded, and stacked although they occupy only a small amount of space, they often become jammed with each other because of their conical feet and can thus be stacked only with great difficulty by hand, and not at all mechanically.

There exist well known pallets which overcome this difficulty by providing clearance supports on their underside to prevent the undesired wedging. However, these clearance supports present yet another disadvantage since they can be easily damaged when handled either by hand or by fork lift.

SUMMARY OF THE INVENTION

It is an objective of this invention to overcome the above-stated disadvantages of the prior art by forming a pallet with stacking members in such a way that the stacking members are better protected against damage.

According to the invention this is accomplished by integrating the stacking members in a projecting crosspiece which emerges from a pallet surface and which is of greater length and width on its underside than on its upperside.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
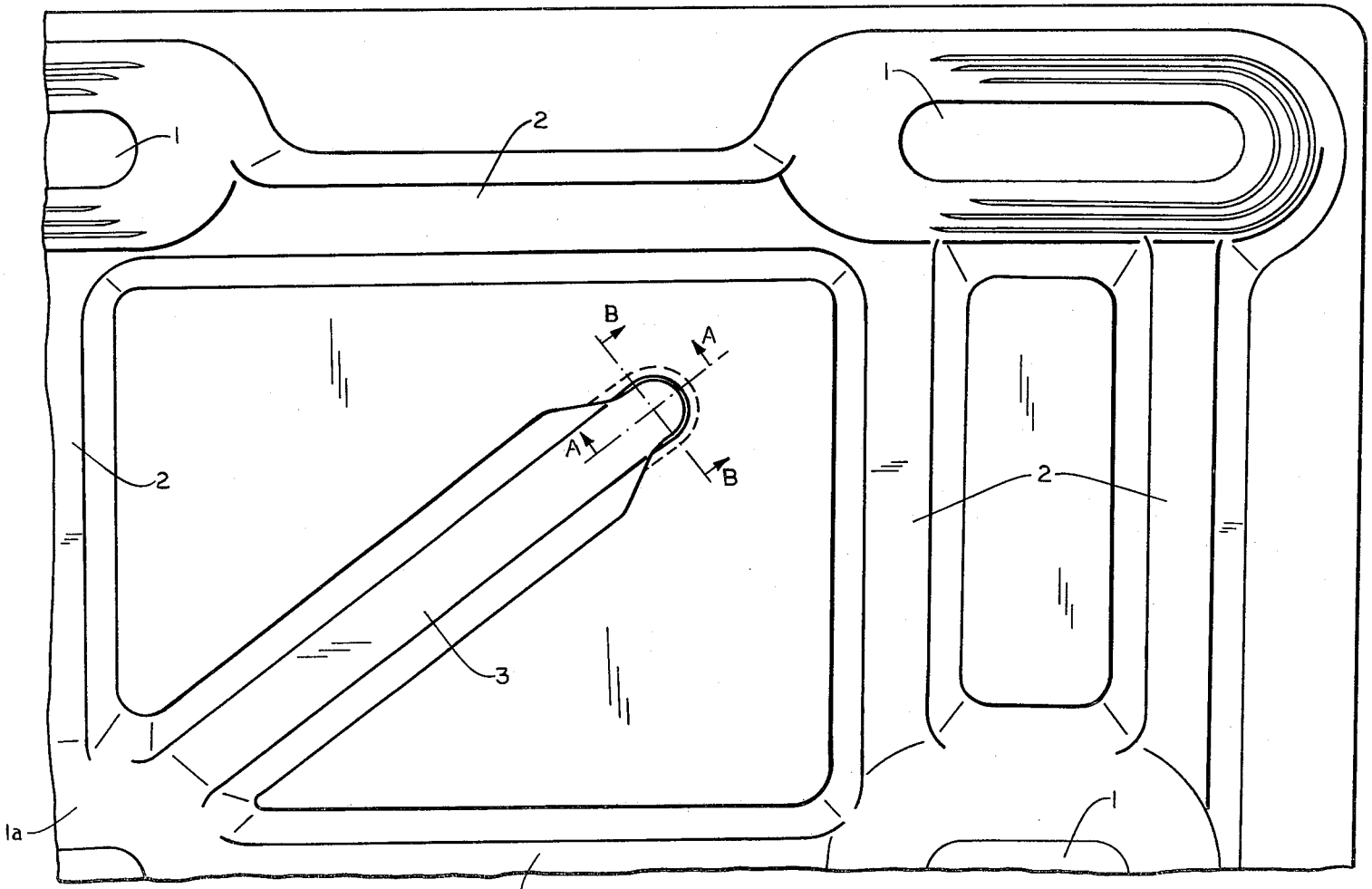
FIG. 1 is a top view of a quarter of a pallet upper surface.

As is shown in FIG. 1 the pallet has one foot 1*a* in the center and several feet 1 spaced around its edge. These feet are generally concavely pot-shaped and conically tapered downward; i.e. into the plane of the drawing. Between the feet 1 are trough-shaped connecting crosspieces 2. In addition, crosspieces 3 (only one shown) extend diagonally from the center foot 1*a* toward each foot 1 located at a corner of the pallet. This crosspiece

Figure 2:
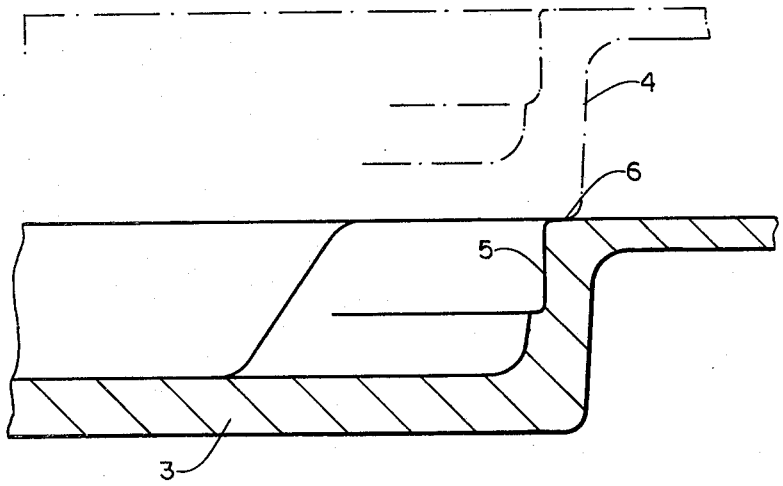
FIG. 2 is a longitudinal section along the line A—A of FIG. 1 showing the end of a crosspiece.
Figure 3:
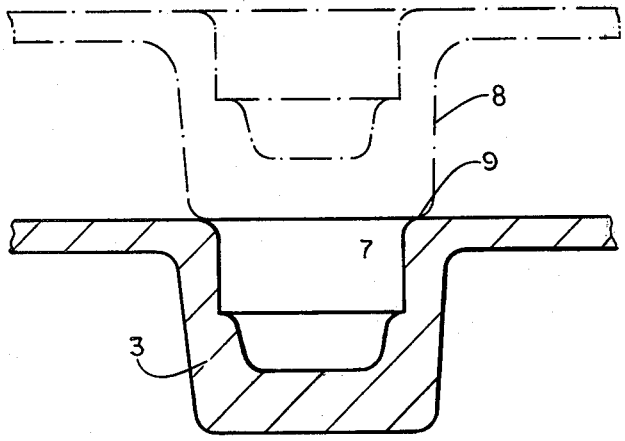
FIG. 3 is a cross-section along the line B—B of FIG. 1 showing the end of a crosspiece.

3 has a projecting end that stops short of the corner foot and the stacking member is integrated in the projecting end as is more clearly shown in FIG. 2 and FIG. 3.

In FIG. 2 the ends of two crosspieces 3 are shown which belong to two different pallets that are in a stacked arrangement. The lower crosspiece is drawn in solid lines and the upper one in broken lines. It can also be seen that the outer limit 4 of crosspiece 3 has a larger magnitude than the inner limit 5. In this way an adequately large bearing surface is provided between the crosspieces of the upper and lower pallets to support a pile of pallets stacked one upon another.

A similar aspect is evident from FIG. 3 which displays a cross-section of the crosspiece 3. The differing widths of the inner opening 7 and the outer limit 8 forms a bearing surface 9 whereby the pallets, which are separated by a "stacking" height, may loosely lie against each other.

In this way the stacking member is integrated in a crosspiece so that it is not exposed and therefore protected from damage.

It will be understood that each of the elements described above, or two or more together, may also find a useful application in other types of pallet differing from the types described above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimd as new and desired to be protected by Letters Patent is set forth in the appended claims.

1. A pallet having an upper side and a lower side and formed as a unitized structure which may be stacked with other such pallets when unloaded in a relatively small space without jamming or damage, the pallet being formed of a mixture of lignocellulose-containing fibers and a thermosetting bonding agent subjected to heat and pressure to form said unitized structure, said structure comprising several feet; crosspieces extending between the neighboring feet; and diagonal crosspieces, said diagonal crosspieces being formed with stacking members integral with said diagonal crosspieces, said stacking members being so formed that the length and width thereof on said lower side are larger than the length and width on said upper side whereby each of said stacking members forms a bearing surface on said lower side which is operative for stacking.

2. A pallet as defined in claim 1, wherein said crosspieces are trough-shaped.

3. A pallet as defined in claim 1, wherein said feet are conically shaped and are downwardly tapered.

4. A pallet as defined in claim 1, wherein said feet are uniformly spaced around the perimeter of said unitized structure and said crosspieces connect said feet in a grid-like manner.

5. A pallet as defined in claim 4, wherein said unitized structure further comprises a foot in the geometric center of said unitized structure and wherein said diagonal crosspieces emanate from said foot toward the respective corners of said unitized structure.

* * * * *